United States Patent [19]

Fox et al.

[11] Patent Number: 4,580,643

[45] Date of Patent: Apr. 8, 1986

[54] ADJUSTABLE BEARING SECTION CORE BARREL

[75] Inventors: Douglas G. Fox, Salt Lake City; Larry C. Greenhalgh, West Valley City, both of Utah

[73] Assignee: Norton Christensen, Inc., Salt Lake City, Utah

[21] Appl. No.: 648,959

[22] Filed: Sep. 10, 1984

[51] Int. Cl.[4] ..... E21B 25/02

[52] U.S. Cl. ..... 175/244; 175/236; 175/239; 175/321; 285/39

[58] Field of Search ..... 175/236, 239, 244, 321; 166/206, 217; 285/39, 140, 145, 310, 319

[56] References Cited

U.S. PATENT DOCUMENTS

| | | | |
|---|---|---|---|
| 2,189,923 | 2/1940 | Phipps | 175/236 |
| 2,784,627 | 3/1957 | Mueller et al. | 285/39 X |
| 2,926,701 | 3/1960 | Campbell | 285/39 X |
| 4,265,470 | 5/1981 | Danner | 285/319 X |

FOREIGN PATENT DOCUMENTS

| | | | |
|---|---|---|---|
| 1449048 | 7/1966 | France | 285/39 |

*Primary Examiner*—Stephen J. Novosad
*Assistant Examiner*—John F. Letchford
*Attorney, Agent, or Firm*—Beehler, Pavitt, Siegemund, Jagger & Martella

[57] ABSTRACT

The longitudinal position of an inner barrel within a core barrel assembly can be adjusted and locked in the field without necessitating the disassembly of the cartridge cap assembly within the core barrel tool, and therefore without entailing loss of expensive rig time. The inner tube is coupled through a swivel assembly to a cartridge cap. The cartridge cap is threadedly coupled to the coring tool, and in particular to the outer tube. Thus, the cartridge cap is arranged and configured to be rotated, and thus longitudinally adjusted with respect to the outer tube. An upper portion of the cartridge cap is provided with a plurality of radially expanding fingers. A jam nut is disposed within a cylindrical array formed by the fingers, and is threadably engaged with the inside surface of the fingers. The jam nut has a frustoconical shape, and thus as the jam nut is advanced longitudinally with respect to the fingers, the fingers are urged outwardly, ultimately in a tight and locking contact with an interior surface of the coring tool. A hollow cylindrical wrench engages the core barrel to rotate it to the desired longitudinal position. A jam nut wrench is disposed through the hollow cylindrical wrench and is used to advance the jam nut downwardly in the fingers to expand the fingers and thus lock the longitudinal position of the cartridge cap.

15 Claims, 5 Drawing Figures

14
12
48
40
42
50
34
10
40
38
90
38
44
46
36
94
60
56
54
58
16
57
62
68
68
52
70
62
64
66
72
20
18
18
72
20
74
22
24
76
78
80
28
26
30
32
82

ADJUSTABLE BEARING SECTION CORE BARREL

BACKGROUND OF THE INVENTION

1. Field of the Invention

The present invention relates to the field of earth-boring tools, and more particularly to a core barrel and a coring tool.

2. Description of the Prior Art

A coring tool is used to cut cylindrical cores from a rock formation, which cores are then retrieved for later laboratory analysis and examination. Thus, a coring tool generally comprises a coring bit which cuts a cylindrical core from the rock formation. As the core is cut, it moves within an inner gage of the coring bit, and is disposed within the outer tube or drill collars which are coupled to the coring bit. The drill collars are in turn coupled to drill pipe which constitutes the outer portion of the drill string and extends to the well surface. Within the outer tube of the coring tool is one or more sections of an inner tube assembly, including a core catcher disposed at the lower end of an inner tube shoe assembly. The core catcher is a device which engages the core through an interference fit and, when the coring tool has an upward tension placed thereon, jams between the core and the inner tube shoe assembly in order to seize the core, break it from the rock formation, and to retain it within the coring tool for retrieval at the well surface.

However, the inner tube assembly as manufactured and assembled in combination with various core bit designs does not have an exact length, but is characterized by a length which varies within a certain range. This range determines then the amount of spacing between the lower end of the inner tube assembly and the coring bit. This displacement is important in establishing the hydraulic communication from the interior of the drill string to the inner gage of the coring bit, and in providing a smooth transition between the inner gage of the coring bit and the lower end of the inner tube in order to minimize the disturbance of the core as the inner tube slides along the length of the core.

In order to accommodate these variations, the prior art practice in the field is to dispose a plurality of shims or washers within the coring tool in order to provide fine adjustments between the inner tube and coring bit. Generally, this requires disassembly of the cartridge cap from the safety pin in order to insert the shims or washers. This disassembly and assembly necessarily entails a certain amount of rig downtime during which all drilling operations are suspended.

Therefore, what is needed is some means whereby the longitudinal adjustment of an inner tube assembly within a coring tool can be quickly and easily made so that the loss of expensive rig time in the field can be avoided.

BRIEF SUMMARY OF THE INVENTION

The invention is an apparatus included within a coring tool whereby longitudinal displacement of the inner tube within the outer tube of the coring tool is selectively adjustable and lockable without requiring disassembly of the coring tool. The apparatus comprises a cartridge cap assembly which is disposed in the outer tube. The cartridge cap assembly is longitudinally adjustable within the outer tube and the inner tube is coupled to the cartridge cap assembly. Thus, by longitudinal adjustment of the cartridge cap assembly, the longitudinal displacement of the inner tube within the coring tool can be arbitrarily selected. The apparatus also includes a locking mechanism for locking the cartridge cap assembly within the outer tube in a selected longitudinal position. In the preferred embodiment, the cartridge cap assembly includes a radially expandable component and the locking mechanism co-acts with the radially expandable component to selectively fix the longitudinal position of the cartridge cap assembly within and with respect to the outer tube.

More specifically, the invention is an adjustable core barrel section in a coring tool, which includes an inner and outer tube. The adjustable section comprises an adjustable cartridge cap, a plurality of fingers and a frustoconical jam nut. The adjustable cartridge cap is telescopically disposed within the outer tube and is provided with external threading. The outer tube is similarly provided with corresponding or mating internal threading. By this means, the cartridge cap and the outer tube are threadably coupled together and are longitudinally displaceable with respect to each other by rotation of the cartridge cap within the outer tube. The plurality of fingers are defined in an upper portion of the cartridge cap. The plurality of the fingers are defined by corresponding plurality of longitudinally extending slots defined through the cartridge cap. The plurality of fingers are characterized by their radial resiliency. The cartridge cap in turn is coupled to the inner tube. Finally, the frustoconical jam nut is telescopically disposed within the plurality of the fingers of the cartridge cap. The jam nut is provided with exterior threading on its frustoconical surface. The plurality of fingers are correspondingly provided with mating internal threading. The jam nut and plurality of fingers are threadably coupled with each other thereby providing for longitudinal displacement of the jam nut within the fingers. By reason of this combination of elements, a longitudinal displacement of the jam nut with respect to the plurality of fingers causes the fingers to radially expand thereby locking the cartridge cap with respect to the outer tube, or allows the fingers to radially contract thereby freeing the cartridge cap with respect to the outer tube.

These and other details and embodiments of the invention can better be visualized and understood by now turning to consider the following drawings wherein like elements are referenced by like numerals.

The invention and its various embodiments are better understood by now turning to the following detailed description.

DETAILED DESCRIPTION OF THE PREFERRED EMBODIMENTS

The present invention permits a longitudinal adjustment of the bearing assembly within the drill string from the top end section of the safety joint assembly, and does not require disassembly of the cartridge cap. This allows the longitudinal displacement between the core catcher and the inside diameter of the coring bit to be easily and quickly adjusted to a preselected distance, as well as generally providing for adjustment of the inner barrel within the coring tool.

A cartridge cap rotating wrench is used to engage the cartridge cap. The cartridge cap is then rotated in either direction to longitudinally advance or retract the cartridge cap within the safety joint assembly to which it is threaded. When the desired longitudinal position of the cartridge cap has been attained, a jam nut wrench is axially inserted through the cartridge cap wrench. The jam nut wrench has a socket projection which mates with a socket indentation in a jam nut which is threadedly coupled in the end of the cartridge cap. This threaded end of the cartridge cap in turn is comprised of a plurality of fingers, thereby allowing for radial expansion. The cartridge cap can then be locked within the safety joint assembly at the adjusted longitudinal position by advancing the jam nut and spreading the fingers of the cartridge cap. The invention is better understood by now turning to consider in detail the preferred embodiment as illustrated in FIGS. 1–5.

Figure 1:
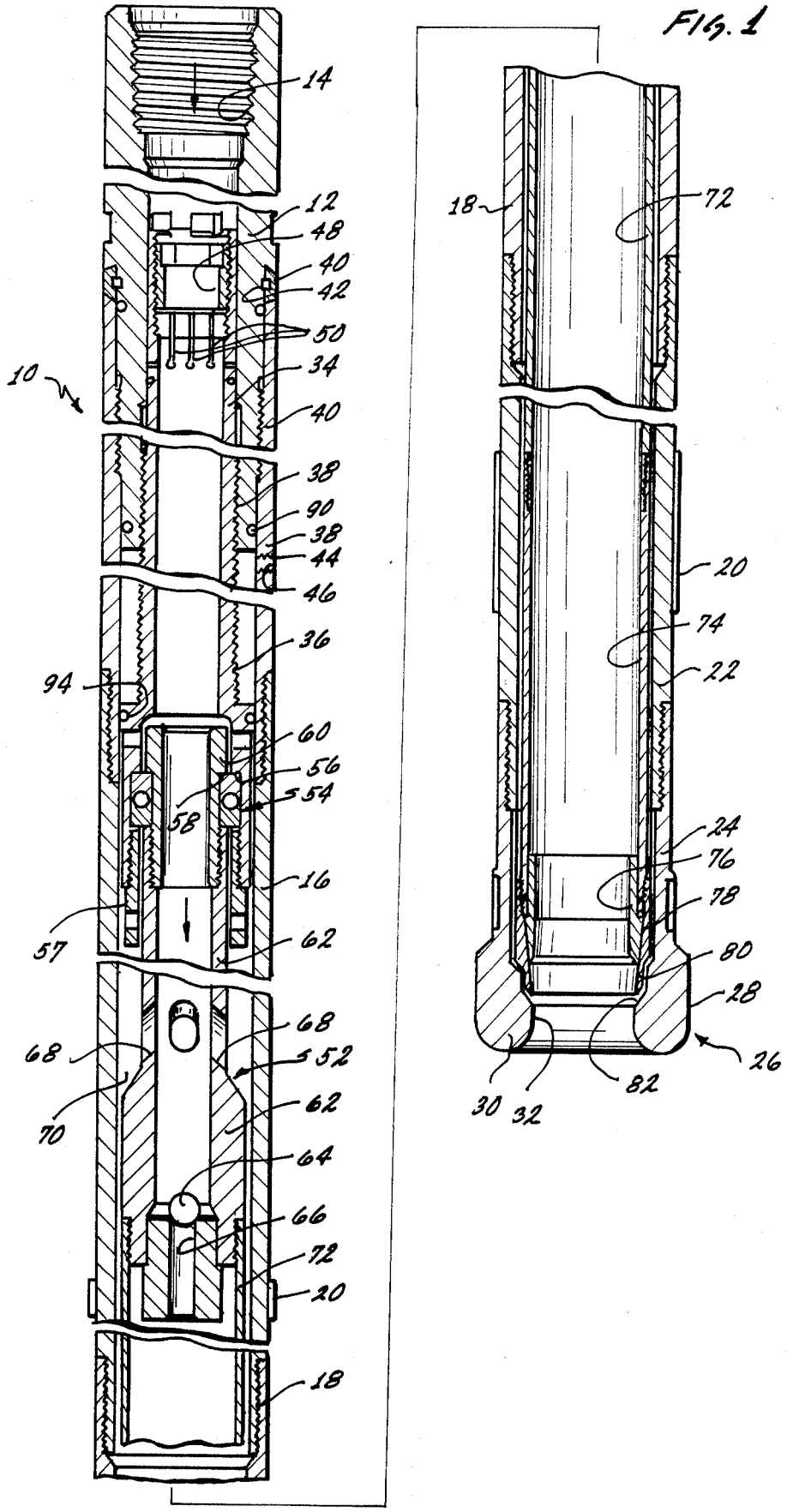
FIG. 1 is a cross-sectional view of a core barrel assembly incorporating the invention.

Turn first to FIG. 1, which illustrates a longitudinal cross-sectional view of a core barrel assembly, generally denoted by reference numeral 10. Core barrel assembly 10 in turn is comprised of a safety joint assembly 12, including a conventional pin and box connection 14 to which drill pipe or collar can be threadably connected. Safety joint assembly 12 in turn is threadably coupled to an outer tube 16. Outer tube 16 is next threadably coupled to outer tube sub 18. A plurality of wear ribs 20 may also be disposed on the outside of outer tube 16, and serve to absorb a substantial part of the friction of wear between the bore hole and the coring tool, which may arise due to an undergage diameter, diametral eccentricity or other irregularities in the bore hole. Outer tube sub 18 in turn is threadably coupled to lower outer tube sub 22, also provided with wear ribs 20. Finally, outer tube sub 22 is threadably coupled to shank 24 of a coring bit, generally denoted by reference numeral 26. Coring bit 26 is comprised of outer gage 28, crown 30, and an inner gage 32. In combination, each of these elements comprise the outer casing of the coring assembly.

Figure 4:
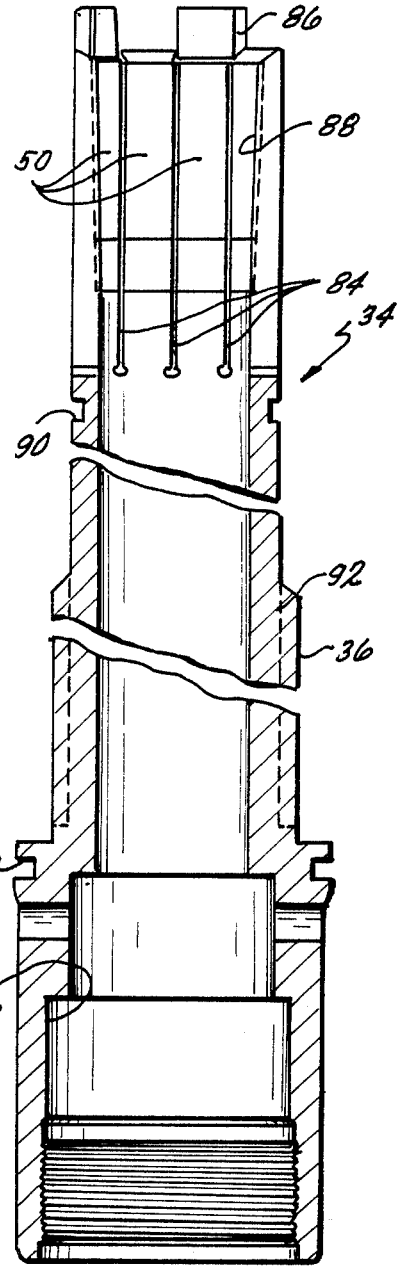
FIG. 4 is a cross-sectional view of the adjustable cartridge cap shown in isolation of the remaining portions of the core barrel assembly.

Consider now the internal components within coring assembly 10, as depicted in FIG. 1. Beginning again at the top of the coring assembly, an adjustable cartridge cap 34, as will be further described in connection with FIG. 4, is threadably disposed within safety joint assembly 12. Adjustable cartridge cap 34 is provided with threading 36 which engages the threading defined in safety joint assembly 12. Safety joint assembly 12 in turn is threadably coupled in turn by threads 40 with internal matching threading defined in lower section 38 of the safety joint assembly. Lower section 38 is coupled to the upper section of safety joint assembly 12 by means of a friction ring 40 circumferentially disposed about the upper section of assembly 12 and locked thereto by means of an annular locking ring 42 which is mutually disposed within an annular groove defined in friction ring 40 and in the upper section of assembly 12. An internal pressure plug 44 is disposed in a radial bore 46 defined through lower section 38, and provides a means for selectively relieving any hydraulic overpressures which may be created within the interior of the drill string, and in particular outer tube 16.

Jam nut 48 is threaded into the upper end of adjustable cap 34. As will be better described and illustrated in connection with FIG. 4, the upper end of adjustable cartridge cap 34 is comprised of a plurality of fingers 50, which are radially expandable by the longitudinal engagement of jam nut 48 within the upper end of cartridge cap 34.

The lower end of cartridge cap 34 is rotatably coupled to a swivel assembly generally denoted by reference numeral 52. Swivel assembly 52 is comprised of a annular ball bearing 54 disposed within an annular raceway 56 of the lower end of cartridge cap 34, and in an adjoining annular recess 58 defined in bearing retainer 60. Bearing retainer 60 in turn is threadably coupled to an inner tube plug 62. Inner tube plug 62 and bearing retainer 60 thus form a single assembly which is rotatably free with respect to outer tube 16 by virtue of ball bearing 54. Therefore, as outer tube 16 rotates, ball bearing 54 allows inner tube plug 62 to remain stationary.

Hydraulic fluid is pumped down the interior of the drill string and enters core barrel assembly 10, as indicated by the arrows, and flows through the pin and box connection 14, through jam nut 48, down the interior of cartridge cap 34 and through bearing retainer 60 into inner tube plug 62. A steel ball 62 is selectively used to plug a longitudinal bore 66, thereby forcing the hydraulic fluid through a plurality of bypass ports 68 defined in inner tube plug 62. The hydraulic fluid is thus forced outwardly to an annular space 70 between inner tube plug 62 and outer tube 16. Although in the present invention, ball 64 is generally disposed and placed to seal bore 66, and thereby force hydraulic fluid through bypass port 68, it is entirely within the scope of the invention that ball 64 may be omitted to allow hydraulic fluid to freely flow into the interior of inner tube 72, or to such other apparatus and mechanisms lying below swivel assembly 52 which may be operative upon the application or withdrawal of hydraulic fluid and pressure caused by the blockage of bore 66 by ball 64. As is conventional in the art, ball 64 in such a case would be dropped into the drill pipe at the well surface, and ultimately would come to rest to lodge against the opening of bore 66.

The lower portion of inner tube plug 62 is threadably coupled to inner tube 72, into which the core is disposed. Inner tube 72 continues longitudinally downward within the core barrel assembly 10 through outer tube subs 18 and 22, and is ultimately threadably coupled to an inner tube shoe assembly 74. Inner tube shoe assembly 74 in turn is arranged and configured at its lower end to accommodate core catcher 76, and to be threadably coupled to an inner tube shoe pilot 78. Inner tube shoe pilot 78 is similarly arranged and configured to coact with core catchers 76, and provides an inwardly tapering frustoconical surface on which core catcher 76 rides. As core catcher 76 is longitudinally displaced downward within the inner tube, this surface serves to radially compress core catcher 76 against the core which is disposed through it.

Thus, inner tube shoe pilot 78 represents the lowermost portion of the inner tube string, and defines a gap 80 between inner tube shoe pilot 78 and the adjacent inner surface 82 of core bit 26.

Before considering the overall operation or adjustment of the inner barrel within core assembly 10, turn first to the longitudinal cross section of cartridge cap 34 shown in isolation from the other elements of the assembly 10. Cartridge cap 34 is clearly illustrated in FIG. 4 as including a plurality of fingers 50 defined by longitudinal slots 84 defined through cartridge cap 34. Thus, fingers 50 comprise a plurality of longitudinally extending fingers capable of resilient radial expansion is described below in greater detail. Alternate fingers 50 are provided with an extended, integral lug 86 for engagement with a cartridge cap wrench, again described in greater detail in connection with FIG. 3. The upper inside portion of fingers 50 is similarly provided with threading 88 with which jam nut 48 is coupled. In their unexpanded configuration, fingers 50 thus provide cylindrical internal threading.

Reviewing for a moment the remaining features of cartridge cap 34, an O-ring groove 90 is defined below fingers 50 in order to provide a hydraulic seal. The O-ring is shown in place in the assembled view of FIG. 1. Threading 36 is defined on a thickened shoulder portion 92 in the middle section of cartridge cap 34, which threading 36 as previously described is coupled to corresponding threading 38 defined in safety joint 12. Threading 36 in cooperation with threading 38 thus provides a means whereby the longitudinal position of cartridge cap 34 within the coring assembly 10 may be finally adjusted by rotation of cartridge cap 34 within coring assembly 10.

Below threading 36 a second O-ring groove 94 is defined, again shown in the assembled view of FIG. 1 with an O-ring in place. Cartridge cap 34 continues downwardly in an expanded bell housing to define a shoulder 58 into which ball bearing 54 will be disposed. Ball bearing 54, as shown in FIG. 1, is then retained within shoulder 58 by means of inner tube plug 62, and cartridge plug 57 on one hand, and bearing retainer 60 on the other, all of which are disposed, at least in part, within the lower portion of cartridge cap 34.

Figure 5:
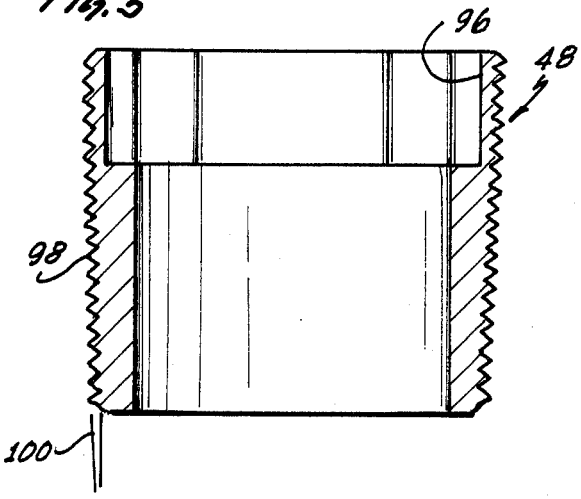
FIG. 5 is a longitudinal cross-sectional view of the jam nut used to lock and unlock the adjustable cartridge cap of FIG. 4 as shown in the assembled view of FIG. 1.

Before considering the tools used to adjust cartridge cap 34, turn now to FIG. 5 wherein a longitudinal section of jam nut 48 is illustrated. Jam nut 48 includes a hexagonal socket 96 defined at its upper end, and includes exterior threading 98 along its outer surface which are engageable with threading 88 defined in the interior of fingers 50 of cartridge cap 34. The outside surface defined by threads 98 of jam nut 48 define a frustoconical shape. In the illustrated embodiment, the angular taper of the exterior surfaces, or of the envelope of threading 98 of jam nut 48, define an angle 100 of 0.75 inches of taper per foot. Thus, jam nut 48 is characterized by a downwardly tapering frustoconical exterior shape with a hex head socket drive 96 formed in its upper portion. The degree of taper can of course be selected at any other value determined by design parameters.

Figure 3:
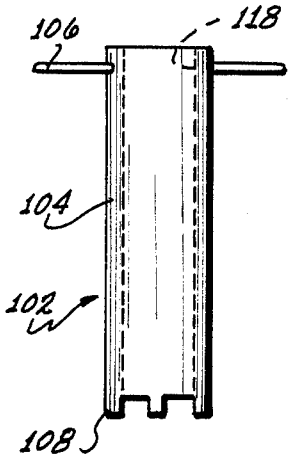
FIG. 3 is a side elevational view of a cartridge cap rotating wrench used to adjust the core barrel section.

Turn now to FIG. 3, which illustrates a cartridge cap rotating wrench generally denoted by reference numeral 102. Wrench 102 includes a hollow cylindrical body 104 with a radial driving handle 106 for hand grasping at one end, and a plurality of annularly disposed teeth 108 at the opposing end. Teeth 108 are arranged and configured to easily slide between lugs 86 of fingers 50, and when thus engaged thereby provide a convenient means for manually applying a torque to cartridge cap 34 through drive handles 106.

Figure 2:
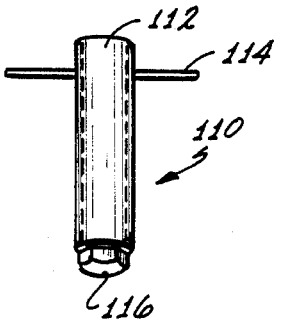
FIG. 2 is a perspective illustration of a jam nut lock wrench used to unlock and lock the adjustable core barrel section.

FIG. 2 illustrates a jam nut lock wrench, generally denoted by reference numeral 110. Jam nut lock wrench 110 is similarly comprised of a cylindrical body 112 having drive handles 114 disposed at one end, and provided with a hex head 116 at the opposing end. Hex head 116 is arranged and configured to appropriately mate and correspond with hex head socket indentation 96 in the upper end of jam nut 48.

The operation or adjustment of the inner barrel within coring tool 10 can now be explained. As coring tool 10 is assembled on the well platform, the interior components, including inner tube 72, are disposed within the outer portions of the drill string, and are threaded therein by means of threading 36 and 38 provided in cartridge cap 34 and safety joint 12, respectively. Cartridge cap 34 is threaded into safety joint 12 by means of wrench 102. When the approximate correct displacement 80 has been obtained between the lowermost end of the inner tube, in the illustrated embodiment a pilot shoe 78, jam nut 48 is then loosely threadably coupled into threading 88 of fingers 50, if not previously in place. As long as jam nut 48 is loosely threaded within fingers 50, jam nut 48 will not expand fingers 50, and will generally rotate with cartridge cap 34. Wrench 110 is then disposed through the hollow cylindrical bore 118 of wrench 102, and engaged with jam nut 48. Jam nut 48 is then tightened, thereby radially expanding fingers 50. Gap 80 is monitored, and wrench 102 appropriately adjusted as jam nut 48 is tightened by means of wrench 110. When the appropriate displacement 80 has been verified, jam nut 48 is then finally tightened, thereby securely locking cartridge cap 34 in place. Wrenches 102 and 110 are then removed, and core barrel assembly 10 connected by pin and box connection 14 to the drill string, and thereafter lowered into the bore hole.

Thus, it may be appreciated that according to the invention a mechanism and design is provided which allows very accurate, easily controllable, fine adjustments of the inner tube longitudinal displacement. When the coring bit is changed, or any other adjustment or change made to the inner tube, displacement 80 may be quickly and accurately readjusted by means of appropriate manipulation through the use of wrenches 102 and 110 without requiring any disassembly whatsoever of core barrel assembly 10 or cartridge cap assembly 34.

Many modifications and alterations may be made by those having ordinary skill in the art without departing from the spirit and scope of the invention. The illustrated embodiment has been set forth only for the purposes of example, and should not be taken as limiting the invention as defined by the following claims.

We claim:

1. An apparatus in a coring tool including an outer tube and inner tube comprising:

cartridge cap means disposed in said outer tube and longitudinally adjustable within said outer tube, said inner tube coupled to said cartridge cap means; and locking means for locking said cartridge cap means within said outer tube in a selected longitudinal position therein, wherein said cartridge cap means comprises a plurality of locking fingers defined at an upper end of said cartridge cap means, said locking fingers being formed in a cylindrical open array, and wherein said locking means comprises a jam nut axially disposed within said cylindrical array of locking fingers and coupled thereto, said jan nut having an exterior frustoconical shape, said jam nut radially expanding said plurality of fingers, as said jam nut is selectively longitudinally displaced with respect to said plurality of fingers, whereby longitudinal placement of said inner tube within said outer tube is selectively adjustable and lockable without disassembly of said coring tool.

2. An apparatus in a coring tool including an outer tube and inner tube comprising:

cartridge cap means disposed in said outer tube and longitudinally adjustable within said outer tube, said inner tube coupled to said cartridge cap means; and locking means for locking said cartridge cap means within said outer tube in a selected longitudinal position therein, wherein said cartridge cap means includes means for adjusting the longitudinal displacement of said cartridge cap means within said outer tube, and wherein said means for adjusting said cartridge cap means within said outer tube comprises mutually engageable threading defined on said cartridge cap means and said outer tube, and means for rotatably driving said cartridge cap means comprises a plurality of lugs integrally extending from selective ones of said plurality of fingers, and a cylindrical cartridge cap rotating wrench arranged and configured to engage said plurality of lugs whereby longitudinal placement of said inner tube within said outer tube is selectively adjustable and lockable without disassembly of said coring tool.

3. The apparatus of claim 2 wherein said means for rotatably driving said cartridge cap means comprises a plurality of lugs integrally extending from selective ones of said plurality of fingers, and a cylindrical cartridge cap rotating wrench arranged and configured to engage said plurality of lugs.

4. The apparatus of claim 3 wherein said locking means is a jam nut having an exterior frustoconical shape and exterior threading, said plurality of fingers provided with interior threading, said interior threading of said fingers and said exterior threading of said locking means being mutually engageable, said jam nut further defining a socket drive, said jam nut disposed within said plurality of fingers and rotatable by application of a torque through said socket drive to selectively longitudinally position said jam nut within said plurality of fingers and to radially expand said plurality of fingers against said outer tube within which said cartridge cap means is disposed, said locking means further comprising a jam nut lock wrench arranged and configured to mate with said socket drive for imparting said torque to said jam nut.

5. The apparatus of claim 4 wherein said cartridge cap rotating wrench includes a cylindrical bore through which bore said jam nut lock wrench is disposable, whereby said cartridge cap rotating wrench and jam nut lock wrench are simultaneously engageable with said cartridge cap means and locking means, respectively.

6. The apparatus of claim 5 wherein said cartridge cap means defines an axial longitudinal bore, and said locking means defines an axial longitudinal bore therethrough to permit hydraulic fluid to flow through said cartridge cap means and locking means.

7. An adjustable core barrel section in a coring tool, including an outer tube and inner tube comprising:

an adjustable cartridge cap, said cartridge cap telescopically disposed within said outer tube and provided with external threading, said outer tube provided with corresponding internal threading, whereby said cartridge cap and outer tube are threadably coupled and longitudinally displaceable with respect to each other;

a plurality of fingers defined in an upper portion of said cartridge cap, said plurality of fingers defined by a corresponding plurality of longitudinally extending slots through said cartridge cap, said plurality of fingers being radially resilient, said cartridge cap coupled to said inner tube; and a frustoconical jam nut telescopically disposed within said plurality of fingers of said cartridge cap, said jam nut provided with exterior threading on said frustoconical surface of said jam nut, said plurality of fingers correspondingly provided with internal threading, said jam nut and plurality of fingers being threadedly coupled with each other and longitudinally displaceable with respect to each other, whereby longitudinal displacement of said jam nut with respect to said plurality of fingers causes said fingers to radially expand thereby locking said cartridge cap with respect to said outer tube, and to radially contract thereby freeing said cartridge cap with respect to said outer tube.

8. The apparatus of claim 7 wherein said cartridge cap defines a plurality of alternating longitudinally disposed lugs, and further comprising a core barrel tool, said core barrel tool comprising:

a cartridge cap rotating wrench, said cartridge cap rotating wrench comprised of a hollow cylindrical body, drive means for applying a torque to said hollow cylindrical body, and an opposing toothed termination on said cylindrical body for engaging said plurality of lugs extending from said cartridge cap, whereby a rotating torque is applied to said cartridge cap; and a jam nut lock wrench, said jam nut lock wrench comprised of a cylindrical body, means coupled to said cylindrical body for applying a driving torque to said cylindrical body, and means for engaging said jam nut to impart said torque to said jam nut, said jam nut lock wrench being axially disposed through said hollow cylindrical cartridge cap rotating wrench, whereby longitudinal displacement of said cartridge cap with respect to said outer tube is selectively adjusted by rotating said cartridge cap with said cartridge cap rotating wrench and then fixing the longitudinal position of said cartridge cap with respect to said out tube by rotating said jam nut by said torque applied by said jam nut lock wrench.

9. The apparatus of claim 7 wherein said jam nut defines an axial bore therethrough, and wherein said cartridge cap defines an axial bore therethrough, thereby allowing hydraulic fluid to pass through said core barrel section.

10. An adjustable core barrel section in a coring tool, including an outer tube and an inner tube comprising:

a cartridge cap;

external threading defined on said cartridge cap;

internal threading defined within said coring tool, said external threading of said cartridge cap mutually engageable with said internal threading defined within said coring tool;

means for rotating said cartridge cap within said coring tool to longitudinally displace said cartridge cap therein through mutual engagement of said exterior threading of said cartridge cap in said interior threading of said coring tool, said inner tube coupled to said cartridge cap and rotatably free with respect to said cartridge cap; and means for locking said longitudinal position of said cartridge cap with respect to said coring tool, whereby longitudinal position of said inner tube within said coring tool is selectively adjustable and fixed.

11. The apparatus of claim 10 wherein said means for locking said cartridge cap with respect to said coring tool comprises means for selectively rotationally fixing said cartridge cap with respect to said coring tool.

12. The apparatus of claim 11 wherein said means for rotationally fixing said cartridge cap with respect to said coring tool comprises means for establishing an interference fit between an exterior surface of said cartridge cap and said coring tool.

13. The apparatus of claim 12 wherein said means for establishing an interference fit comprises a radially expandable portion of said cartridge cap, and means for selectively radially expanding said expandable portion.

14. The apparatus of claim 13 wherein said expandable portion of said cartridge cap comprises a plurality of radially resilient longitudinally extending fingers; and wherein said means for expanding said portion of said cartridge cap comprises:

internal threading defined on said plurality of fingers;

a jam nut telescopically disposed within said plurality of fingers, said plurality of fingers forming a cylindrical array; and exterior threading defined on said jam nut, said exterior threading and jam nut characterized by a frustoconical shape so that longitudinal displacement of said jam nut within said cylindrical array of fingers radially expands said cylindrical array of fingers.

15. The core barrel section of claim 14 wherein said means for rotating said cartridge cap further comprises a cartridge cap rotating wrench having a longitudinal bore defined therethrough, said cartridge cap and cartridge cap rotating wrench arranged and configured for a mutual engagement so that a torque applied to said cartridge cap wrench is transmitted to said cartridge cap, and wherein said means for rotationally fixing said cartridge cap with respect to said coring tool comprises a jam nut wrench arranged and configured to engage said jam nut and to transmit torque through said jam nut wrench to said jam nut.

* * * * *